US005396824A

United States Patent [19]

Souza, Jr.

[11] Patent Number: 5,396,824

[45] Date of Patent: Mar. 14, 1995

[54] GUITAR WORK STATION

[76] Inventor: Edward P. Souza, Jr., 109 Richard Dr., Tiverton, R.I. 02878

[21] Appl. No.: 251,225

[22] Filed: May 31, 1994

[51] Int. Cl.[6] ..... G10D 3/00

[52] U.S. Cl. ..... 84/327; 248/121; 248/346

[58] Field of Search ..... 84/327; 248/121, 166, 248/176, 346, 461

[56] References Cited

U.S. PATENT DOCUMENTS 1,684,912 9/1928 Dunklau ..... 84/327
1,772,308 8/1930 Ezzelle ..... 84/327
2,522,345 9/1950 Cashiopp ..... 248/121
3,958,786 5/1976 Mann ..... 248/176

*Primary Examiner*—Michael L. Gellner
*Assistant Examiner*—Patrick J. Stanzione
*Attorney, Agent, or Firm*—Robert J. Doherty

[57] ABSTRACT

A work station and support for quitars such that they are held in a safe and convenient position while being tuned or repaired in which an elevated base wall supports the guitar butt while an elevated cradle longitudinally disposed therefrom enables the guitar neck to be supported at a higher level.

9 Claims, 2 Drawing Sheets

GUITAR WORK STATION

BACKGROUND AND OBJECTS OF THE INVENTION

This invention relates to a work station for guitars. Guitars and especially electric guitars require periodic adjustment, tuning etc. prior to and often between sets of performance such that a need exists for a device and particularly a portable device which serves as a work station for supporting and placing in a position such that these tasks are rapidly performed without damaging such instruments.

It is, accordingly, an object of the present invention to provide an electric guitar work station which is easily portable and yet functions to safely and conveniently support a guitar while being tuned, adjusted, etc.

A further object of the present invention is to provide an electric guitar work station which enables a variety of variously shaped guitars to be supported while being worked on in a convenient and safe manner.

These and other objects of the present invention are provided by a work station for an electric guitar having a body and neck extending longitudinally therefrom comprising an essentially flat elongated platform having a top surface formed by upper and lower portions positioned longitudinally adjacent each other for respectively receiving the neck and body of said guitar, said lower portion including an upstanding generally U-shaped bottom wall for supporting said guitar body and having a generally concave curved inner surface terminating at laterally opposed sides in a pair of laterally extending walls each in turn having a short inner surface, said top portion including a plurality of positioning means for receiving a support vertically upstanding from said upper surface and in turn adapted for receiving and supporting said guitar neck above said upper surface, said positioning means aligned along the longitudinal direction of said platform and in addition longitudinally spaced from each other, and support alternatively positionable in any one of said positioning means so as to accommodate variously sized guitars on the upper surface of said platform.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 1:
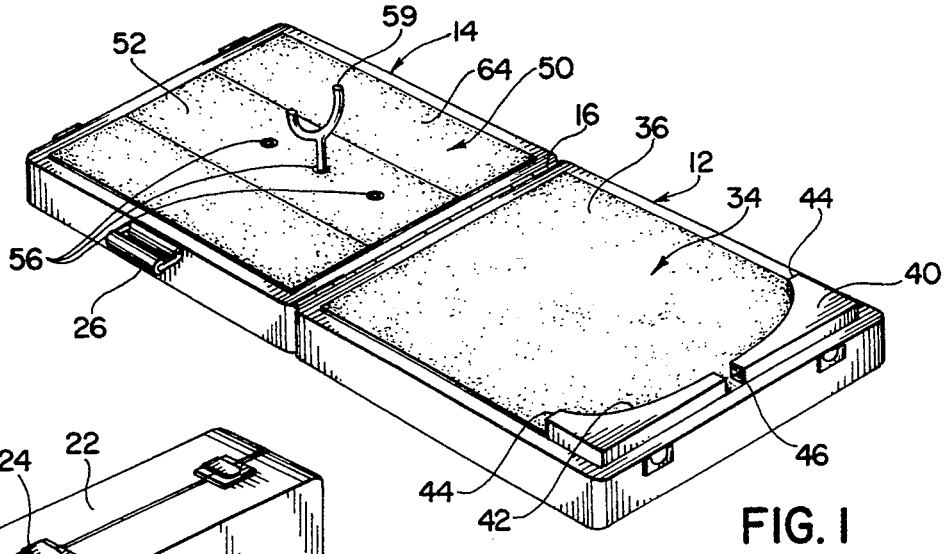
FIG. 1 is a top perspective view of one embodiment of the device of the present invention in an open work position showing a guitar supported thereon in dotted line representation.
Figure 1A:
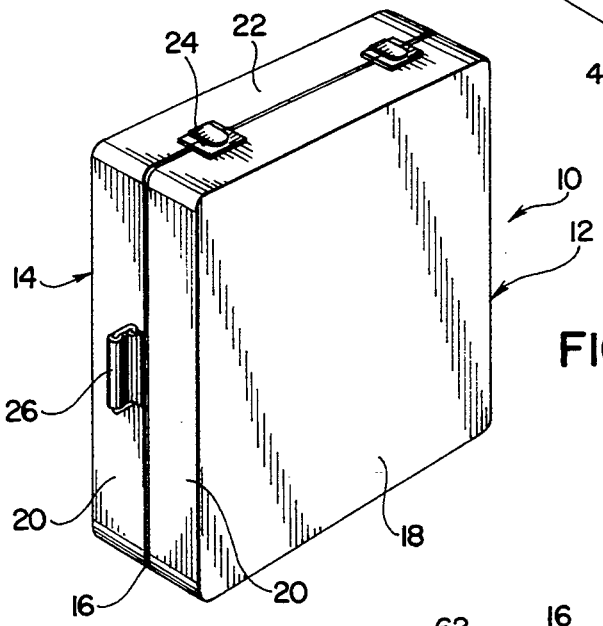
FIGS. 1*a* is a perspective view of the device shown in FIG. 1 in a closed travel position.
Figure 2:
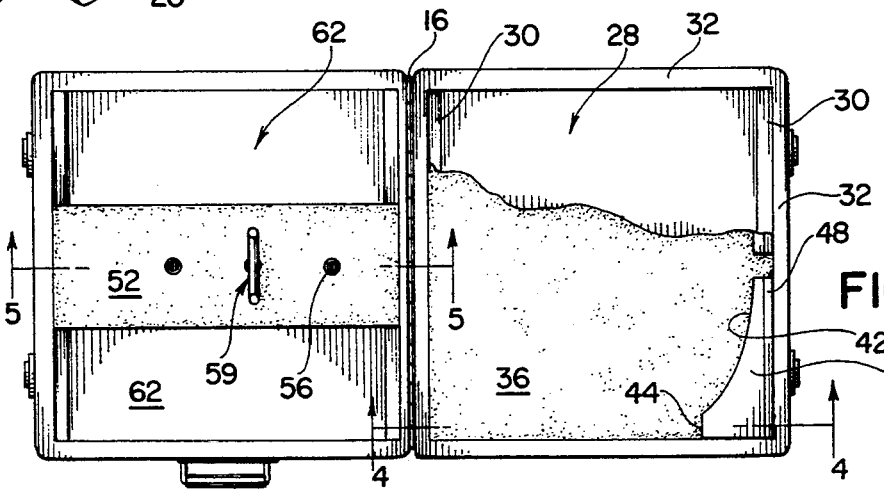
FIG. 2 is a top plan view with portions cut away and panels removed of FIG. 1.
Figure 3:
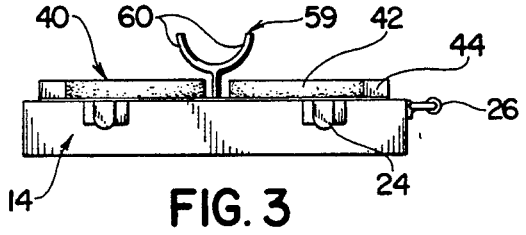
FIG. 3 is a left end view of the device of FIG. 1.
Figure 6:
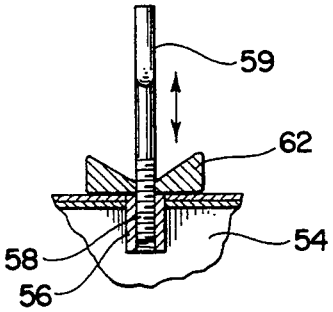
FIG. 6 is an enlarged partial section view showing the adjustability and retention means for the neck support portion of the present device.
Figure 5:
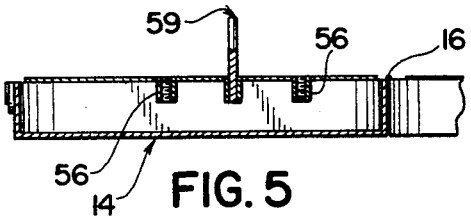
FIG. 5 is a side sectional view taken along the line 5—5 of FIG. 2.

Turning now to the drawings and particularly FIGS. 1 and 1*a*, the overall configuration of one form of the invention is specifically depicted. Therein a folding case 10 is shown having hinged sides 12 and 14 adapted to be closed in face to face relationship to each other as shown in FIG. 1*a* and open to a work position as shown in FIG. 1. In the closed position, the case sides 12, 14 are hinged along a connecting edge 16 and in general include bottom walls 18, side walls 20 and end walls 22. The end walls 22 when disposed in side to side relationship are provided with known latch means 24 such that the sides 12, 14 are secured one to the other so as to form the overall case structure shown and a handle 26 provided on one of the side walls 20 to enable the case to be transported from place to place in a convenient manner.

The lower case half 12 includes a recessed interior portion 28 defined by the interior surfaces of walls 18, 20 and 22 and further includes downwardly recessed ledges 30 at opposed ends thereof. Such ledges 30 are disposed downwardly from the peripheral edge 32 of the case 12. A relatively flat lower panel 34 having a first surface 36 and a second opposed surface 38 is adapted to rest on the ledges 30 such that the panel 34 and the peripheral edges 32 form a continuous generally flat even surface when assembled in the intended manner.

Figure 4:
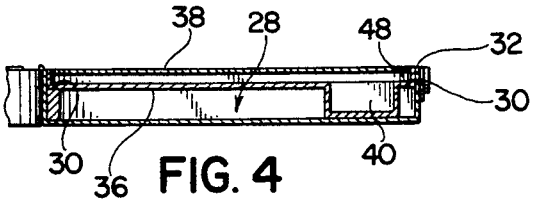
FIG. 4 is a side sectional view taken along the line 4—4 of FIG. 2.
Figure 7:
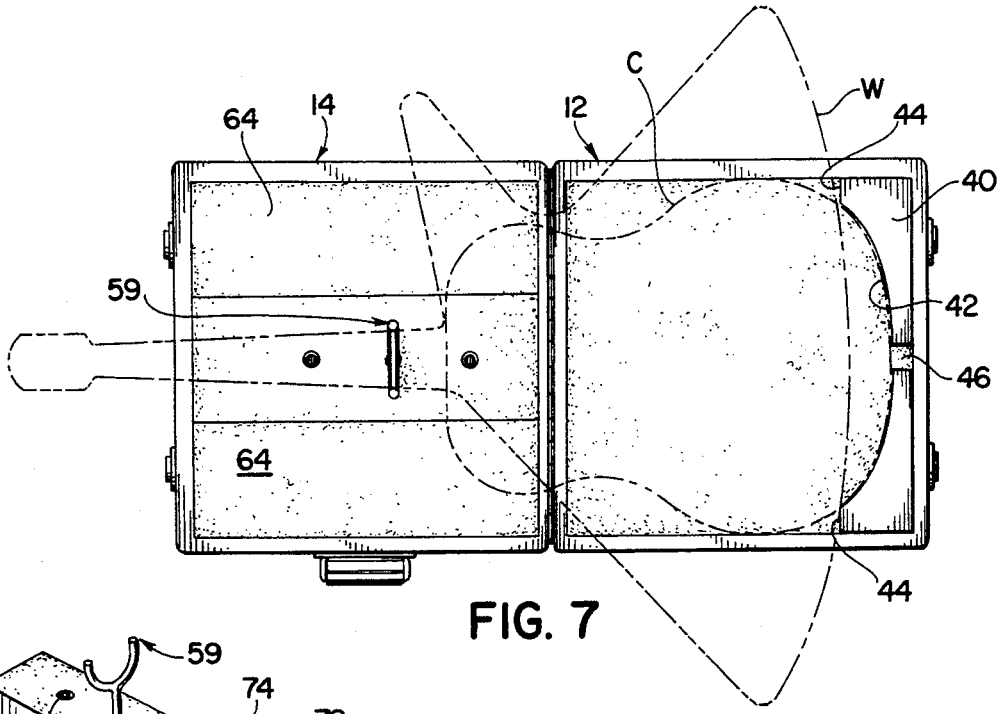
FIG. 7 is a top plan view similar to FIG. 2 but showing the manner in which differently configured guitars are supported by the brace portion of the device.

The surface 36 of the panel 34 is additionally provided with a generally U-shaped bottom wall 40 extending upwardly from the first surface 36 thereof and positioned proximal the lower end thereof. The upstanding wall 40 includes a generally concave inner surface 42 and terminates at opposite sides in a short inner surface 44 for a purpose which will hereinafter be more fully brought out. Centrally of the wall 40 is a slotted opening 46 into which the centrally disposed rearwardly extending strap lug of a guitar body butt end may be conveniently received. As best shown in FIG. 4, the height of the wall 40 is such that it preferably rests on the bottom surface of the recess 28 when in a storage or non-use position and extends upwardly enough so as to adequately support the butt end of a guitar especially formed in the classical guitar shape which is shown by the dotted letter representation C in FIG. 7. The laterally extending walls 44 are in turn adapted to contact and thus support wing-shaped type guitar bodies as shown by the dotted line representation W in the drawings.

Thus when the case is its in open position, the lower panel 34 is adapted to be removed from the case side 12 and then reversed such that the wall 40 is positioned uppermost. In that regard, it should be pointed out that there is a base extension or lip 48 extending rearwardly from the wall 40 and adapted to rest upon the lower recess 30 to provide firm support for the platform in this use position. As previously indicated in this use position, the inner U-shaped surface 42 of the wall 40 is adapted to form a butt brace that will firmly cradle most available guitar styles; but as also previously indicated, other guitar styles such as the wing-shape type are adapted to span the U-shaped wall portion and contact the outer surfaces of the laterally extending minor walls 44. In this way then, the guitar base portion is supported and when placed upon the upper surface of the platform 34 is prevented from rearwardly sliding off the platform and to some extent from moving in a lateral direction.

The upper side 14 of the case 10 is also provided with, in effect, an upper panel 50 which appropriately takes the form of a central panel portion 52 which is fixed in relationship with the case side 14 as by the positioning of a solid member 54 lengthwise of the case portion 14, that is, from front to rear. This member 54 as with other interior portions of both of the case sections 12 and 14, are preferably coated with a anti-scratch or flocked material such that the surfaces that might contact the guitar body or neck are not apt to cause scratches or gouges in the instrument. Such member 54 is further provided with a series of longitudinally extending and spaced threaded sockets preferably constructed of metal and embedded in the member 54. Such sockets 56 are adapted to receive the lower metal threaded rod 58 of the neck brace 59 which in turn terminates in its upper portion in a bifurcated cradle formed by a pair of opposed upstanding arms 60. It is into this cradle 59 that the neck of the guitar is adapted to rest. In order to provide the correct angle for comfortably working on the neck and other portions of the guitar including the body, it is desirable to have the guitar neck upwardly displaced with relationship to the body, that is, supported in the cradle 59 at a higher vertical distance off the upper surface of the platforms 34 and 50. This not only enables convenient manipulation of the various neck thumb screws, wires and frets, but also gives access to lower portions of the guitar body. In addition, the upward angular position as above described tends to force the butt of the guitar base into closer proximity with the wall 40 whereby it is cradled in the desired supporting position.

In other to adjust this vertical height, the extent to which the threaded rod is received in the insert can be limited by a fastening means such as the wing nut 62 depicted. Also as is evident, the support brace or cradle may be removed from one of the inserts and moved to one of the other inserts either closer to or further from the guitar body so in additional way be able to raise or lower the guitar position and also provide for a convenient resting relationship of the cradle 59 with respect to the guitar neck taking into consideration variously sized and shaped guitars. In addition as most guitar bodies are provided with a outwardly extending rearwardly extending strap lug, the slotted opening 46 is provided for the purpose of receiving such.

Preferably the upper case 14 includes recessed areas on each side of the central panel 52 for convenient containment of supplies, tools and the like for the repair and maintenance of guitars. Such recess compartments 62 are conveniently provided with covers or sub-panels 64 also adapted to rest on stops such that an entire flat surface similar to that presented by panel 36 is achieved in the upper case side 14 as well as on the lower case side 12. This enables a neater, less cluttered combination work surface to be presented.

Figure 8:
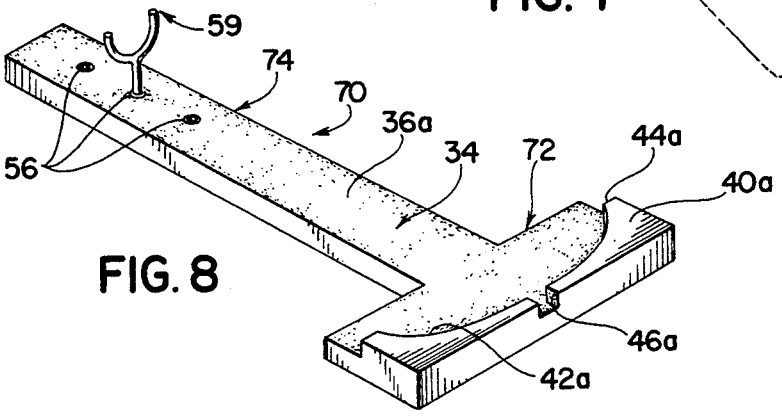
FIG. 8 is a top perspective view showing a further embodiment of the present device.

Turning now to FIG. 8, an added embodiment of the present device is shown wherein a guitar work station in a simplified form which is primarily adapted to be permanently attached to a underlying work surface such as in guitar store repair rooms and the like is depicted. Such alternate device 70 includes a butt brace portion 72 and an elongated neck brace portion 74 forming an overall T-square type shape to the implement. The neck brace portion is provided with a series of threaded inserts 56 as in the previous embodiment and also adapted to receive the cradles 59 whereby the guitar neck portion may be supported as previously explained. The butt support portion 72 is also provided with an elevated wall **40*a*. The upper panel 34*a* is foreshortened as compared to 34 but provides a top surface 36*a* sufficient for underlying support of the base portion of the guitar. Thus it may be seen that the device 70 is already assembled and forms, in effect, a permanent version of the device shown in the previously described embodiment and one which functions in the same manner. Of course, there is no need for a lip 48 since the device 70 is not supported on a ledge as provided in the previous embodiment. The device 70 does, however, include butt surfaces 42*a* and short inner surfaces 44*a* especially adapted to contact wing-type guitars as well as the slot 46*a*. In addition, it is possible to hinge device 70 into two parts approximately mid way along the neck brace portion 74** should a shorter, more travel worthy embodiment be desired.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A work station for an electric guitar having a body and neck extending longitudinally therefrom, comprising an essentially flat elongated platform having a top surface formed by upper and lower portions positioned longitudinally adjacent each other for respectively receiving the neck and body of said guitar, said lower portion including an upstanding generally U-shaped bottom wall for supporting said guitar body and having a generally concave curved inner surface terminating at laterally opposed sides in a pair of laterally extending walls each in turn having a short inner surface, said upper portion including a plurality of positioning means aligned along the longitudinal direction of said platform and in addition longitudinally spaced from each other, a support vertically upstanding from said upper portion adapted to receive and support said guitar neck above said top surface, said support alternatively positionable in any one of said positioning means to accommodate variously sized guitars on said top surface of said platform.

2. The device of claim 1 wherein said platform top surface including said bottom wall is provided with a relatively soft covering so as to avoid scratching said guitar.

3. The device of claim 1, wherein said guitar body has a centrally disposed rearwardly extending strap lug and said bottom wall having a generally centrally disposed longitudinally directed slotted opening for receipt of said guitar strap lug.

4. The device of claim 1, wherein said support is in the form of a lower member terminating at its upper end in a bifurcated yoke.

5. The device of claim 4 wherein said lower member is a rod threaded at its lower end and said positioning means being threaded nut means for alternatively receiving said threaded rod and locking means for fixing the position of said rod with respect to said nut means.

6. A portable work station for electric guitars having a body and neck longitudinally extending therefrom comprising an essentially flat elongated platform having a top surface formed by upper and lower portions positioned longitudinally adjacent each other for respectively receiving the neck and body of said guitar, said lower portion including an upstanding generally U-shaped bottom wall having a generally concave curved inner surface terminating at laterally opposed sides in a pair of laterally extending walls each in turn having a short inner surface, said upper portion including a plurality of positioning means aligned along the longitudinal direction of said platform and in addition longitudinally spaced from each other, a support vertically upstanding from said upper portion adapted to receive and support said guitar neck above said top surface, said support alternatively positionable in any one of said positioning means to accommodate variously sized guitars on said top surface of said platform, said platform upper and lower portions hingedly connected to each other along a lateral line centrally disposed across the longitudinal extent thereof, said portions foldable upon each other along said hinge line to a closed position with said upper and lower portions of said top surface disposed face to face in said folded position and means to hold said work station in said closed position.

7. The device of claim 6, wherein each of said portions is in the form of a rectangular box having upper, lower and intermediate connecting side walls with the upper wall of said lower portion and the lower wall of said upper portion hingedly connected, said boxes in addition having outer walls and inner walls vertically spaced from each other and interconnected to said top, bottom and side walls so as to form hollow interiors in said boxes, said inner box walls forming said top surface when said device is disposed in its open position with said inner box walls adjacent each other.

8. The device of claim 7, wherein a pair of longitudinally oriented storage compartments are laterally spaced from each other in said upper box, said inner surface of said upper box provided with removable covers disposed over said storage compartments, the area of said upper box inner surface disposed between said compartments receiving said positioning means.

9. The device of claim 7, wherein the lower box is hollow with an open upper face closable by a reversible panel, said panel having opposed first and second surfaces, the first surface being essentially flat and the second surface having said U-shaped bottom wall upstanding therefrom, the height of said U-shaped bottom wall being approximately equal to the depth of said bottom box, said panel positionable in said box with said flat surface up when the device is positioned in its folded position and with said panel U-shaped wall up when the device is positioned in its open work position.

* * * * *